US010654624B2

(12) United States Patent
Sung

(10) Patent No.: US 10,654,624 B2
(45) Date of Patent: May 19, 2020

(54) CONTAINER CAP EASILY SEPARATE COLLECTION

(71) Applicant: Bo Youn Sung, Seoul (KR)

(72) Inventor: Bo Youn Sung, Seoul (KR)

( * ) Notice: Subject to any disclaimer, the term of this patent is extended or adjusted under 35 U.S.C. 154(b) by 0 days.

(21) Appl. No.: 15/584,034

(22) Filed: May 2, 2017

(65) Prior Publication Data

US 2018/0170625 A1 Jun. 21, 2018

(30) Foreign Application Priority Data

Dec. 16, 2016 (KR) ..... 10-2016-0172922
Feb. 6, 2017 (KR) ..... 10-2017-0016328

(51) Int. Cl.

| | |
|---|---|
| ***B65D 41/34*** | (2006.01) |
| ***B65D 85/72*** | (2006.01) |
| ***B65D 49/12*** | (2006.01) |
| ***B65D 55/16*** | (2006.01) |
| ***B65D 25/42*** | (2006.01) |
| ***B65D 43/16*** | (2006.01) |
| *B65D 41/38* | (2006.01) |

(52) U.S. Cl.

CPC ..... *B65D 41/34* (2013.01); *B65D 25/42* (2013.01); *B65D 41/3447* (2013.01); *B65D 43/16* (2013.01); *B65D 49/12* (2013.01); *B65D 55/16* (2013.01); *B65D 85/72* (2013.01); *B65D 2101/0046* (2013.01); *B65D 2251/10* (2013.01); *B65D 2565/385* (2013.01)

(58) Field of Classification Search

CPC ..... B65D 41/34; B65D 25/42; B65D 43/16
USPC ..... 215/243, 252, 256, 258; 220/291
See application file for complete search history.

(56) References Cited

U.S. PATENT DOCUMENTS 3,904,062 A * 9/1975 Grussen ..... B65D 41/3447 215/252
4,394,918 A * 7/1983 Grussen ..... B65D 41/3428 215/243
4,557,393 A * 12/1985 Boik ..... B65D 41/48 215/252
4,720,018 A * 1/1988 Schetzsle ..... B26D 3/08 215/252

(Continued)

FOREIGN PATENT DOCUMENTS

CN 1085179 A 4/1994
FR 1164846 A 10/1958

(Continued)

*Primary Examiner* — J. Gregory Pickett
*Assistant Examiner* — Niki M Eloshway
(74) *Attorney, Agent, or Firm* — Maschoff Brennan

(57) ABSTRACT

The present disclosure relates to a container cap which is easily and separately collected and, more particularly, to a container cap which is easily and separately collected, in which when the container cap is opened for use, a state in which the container cap is connected to a container is maintained by a display ring, and when it is required to completely separate the container cap from the container for separate collection, the display ring is simply separated by a cut part by external force without a separate tool. To achieve this, the cut part including cut bridges formed from one end or both ends of a cut silt in a lengthwise direction of the cut slit to a lower end of the cut slit is formed in a container cap having a cap body and a display ring.

6 Claims, 6 Drawing Sheets

(56) References Cited

U.S. PATENT DOCUMENTS

| | | | | |
|---|---|---|---|---|
| 4,798,301 | A * | 1/1989 | Bullock | B65D 41/485 215/256 |
| 5,358,131 | A | 10/1994 | McCandless et al. | |
| 5,853,095 | A * | 12/1998 | Marshall | B65D 41/3428 215/252 |
| 7,134,567 | B2 * | 11/2006 | Luburic | B65D 43/0256 220/276 |
| 7,712,619 | B2 * | 5/2010 | Schwarz | B65D 41/3428 215/252 |
| 2005/0269281 | A1 * | 12/2005 | Ding | B65D 41/48 215/254 |
| 2010/0326948 | A1 * | 12/2010 | Campbell | B65D 41/34 215/252 |
| 2011/0114593 | A1 | 5/2011 | Ishii et al. | |
| 2012/0285921 | A1 * | 11/2012 | Kwon | B65D 41/3447 215/243 |
| 2015/0251827 | A1 * | 9/2015 | Campbell | B65D 55/16 215/252 |

FOREIGN PATENT DOCUMENTS

| | | | |
|---|---|---|---|
| KR | 20-2010-0003990 | | 4/2010 |
| KR | 101325850 | B | 11/2018 |

* cited by examiner

CONTAINER CAP EASILY SEPARATE COLLECTION

CROSS-REFERENCES TO RELATED APPLICATIONS

The present application is related to the Korean Patent Application No. 10-2016-0172922, filed Dec. 26, 2016 and the Korean Patent Application No. 10-2017-0016328, filed Feb. 6, 2017, the entire disclosure of which is expressly incorporated by reference herein.

BACKGROUND OF THE INVENTION

1. Field of the Invention

The present disclosure relates to a container cap which is easily and separately collected and, more particularly, to a container cap which is easily and separately collected, in which when the container cap is opened for use, a state in which the container cap is connected to a container is maintained by a display ring, and when it is required to completely separate the container cap from the container for separate collection, the display ring is simply separated by a cut part by external force without a separate tool.

2. Description of the Related Art

In general, a container in which beverage such as mineral water or liquid materials such as oil, paint and chemicals are accommodated has a protruding spout through which liquid materials are input/output. Here, a container cap configured to open/close an opening of the spout is used to suppress input/output of the liquid materials.

FIG. 1 is a view illustrating a general container and a general container cap. Referring to FIG. 1, in the general container 10 and the general container cap 20, a male screw M/S is formed on an outer peripheral surface E/S of a protruding spout of the container 10 and a female screw F/S is formed on an inner peripheral surface I/S of the covering cap 20 to correspond to the male screw M/S, so that the container 10 and the container cap 20 are screw-coupled to each other or are uncoupled from each other.

Here, the container cap 20 includes a display ring 21 caught by the spout of the container 10 to be prevented from being separated so as to identify whether the container 10 is used, and a cap body 22.

Further, the cap body 22 and the display ring 21 are connected to each other along a circumference therebetween by a plurality of bridges 23.

Accordingly, if the cap 20 is opened when a user uses the container, the bridges 23 are cut, and thus opening trails are generated. Here, the display ring 21 is separated from the cap body 22 and remains while being caught by the spout of the container, and the cap body 22 is completely separated from the container.

Meanwhile, when the container cap 20 of FIG. 1 is completely separated from the container 10, there is possibility of contamination and concern of loss. To prevent this, a recently-developed container cap is connected to the spout of the container even when the spout of the container is opened.

Examples thereof include Korean Patent No. 10-1325850 (Packing container cap: hereinafter, referred to as "prior art 1") and Korean Patent No. 10-1038894 (Packing container cap: hereinafter, referred to as "prior art 2").

Referring to FIG. 2, a container cap according to the prior art includes a cap body 22' and a portion, that is, a display ring 21', fixed to a container integrally formed at a lower portion of the cap body 22'.

Further, a plurality of bridges 23 are formed along a circumference between the cap body 22' and the display ring 21' except for a portion thereof, and a hinge 25 connecting the cap body 22' and the display ring 21' to each other is formed at the portion.

Further, the display ring 21' has a cut slit 24 formed by cutting the portion of the circumference, to define an extending length when the cap body 22' is separated from the container 10.

Meanwhile, the general container cap including the above-described prior arts 1 and 2 as well as the container is separately collected after liquid materials are completely consumed and is recycled.

Further, the container 10 is generally formed of polyethylene phthalate (PET), and further, the container caps 20 and 20' are generally formed of polypropylene (PP) or polyethylene (PE).

In this way, the container and the container cap are formed of different materials, and it is preferred that, to improve recycling efficiency, the container and the container cap are collected in accordance with materials to ensure properties of the corresponding materials.

However, the container caps 20 and 20' according to the related art have a problem in that, because the display rings 21 and 21' are collected while being fixed to the container 10 after being used, the display rings 21 and 21' are recycled together with the container.

Because of this, to completely separate the container and the container cap having different materials from each other, collect the container and the container cap in accordance with materials, and individually recycle the container and the container cap, a collection worker should perform an operation of cutting and separating the display rings 21 and 21' from the container 10 by using tools such as a knife and nippers.

In this way, in the container having the container cap according to the related art, a secondary operation of cutting and separating the display rings using tools is required to separate the container and the container cap from each other in accordance with materials to recycle the container and the container cap. Further, development of a container cap which is easily and separately collected according to materials is acutely required.

BRIEF SUMMARY OF THE INVENTION

The present disclosure is conceived to solve the above-described problems, and an aspect of the present disclosure is to provide a container cap for easy separate collection, in which a display ring as well as a cap body may be completely separated from a spout of a container, so that recycling efficiency may be improved.

To achieve the above aspects, a container cap which is easily and separately collected, according to the present disclosure, may include a cap body using a screw-coupling scheme and a display ring provided below the cap body to connect one hinge and a plurality of bridges to each other, and has a loss and free rotation preventing function.

Here, the display ring may have a cut part including cut bridges formed from one end or both ends of the cut slit in a lengthwise direction of the cut slit to a lower end of the cut slit.

Further, the display ring may further have an anti-shock hole formed between an end of the cut slit and an end of the cut part, which is in contact with the end of the cut slit.

Further, a guide groove that is thinner than a thickness of the display ring may be formed in a portion of the cut part, in which the cut bridges are formed.

Meanwhile, the cut part may have a slope a at a cut slit end and is formed toward a lower end of the display ring, at which the cut slit is not formed.

In addition, the anti-shock hole of the cut part may have an interval that is larger than an interval formed by the cut slit, and an upper end of the anti-shock hole may be higher than an end of the cut slit.

In this way, a container cap which is easily separated and collected, according to the present disclosure, has an effect that a user may completely separate a spout of a container and a display ring from each other only by applying external force pulling a cap body by a cut part formed at an end of a cut slit of the display ring, so that the container and the container cap having different materials may be discriminately, easily and separately collected.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF THE INVENTION

Hereinafter, exemplary embodiments of a container cap which is easily and separately collected, according to the present disclosure, will be described in detail with reference to the accompanying drawings.

Further, the present disclosure will be described with reference to a state in which a container having the container cap installed therein stands, that is, a state in which a spout of the container extends upward, the expression "inside" refers to a central direction of an inside of the container at the corresponding height or a portion located in the direction, and the expression "outside" refers to a direction that is opposite to the inside or a portion located in the direction.

Further, the height refers to an interval between the container including the container cap and a floor in a state in which the container stands up.

Meanwhile, in description of the present disclosure, detailed descriptions of the widely-known functions or configurations will be omitted to make the subject matter of the present disclosure clear.

Figure 1:
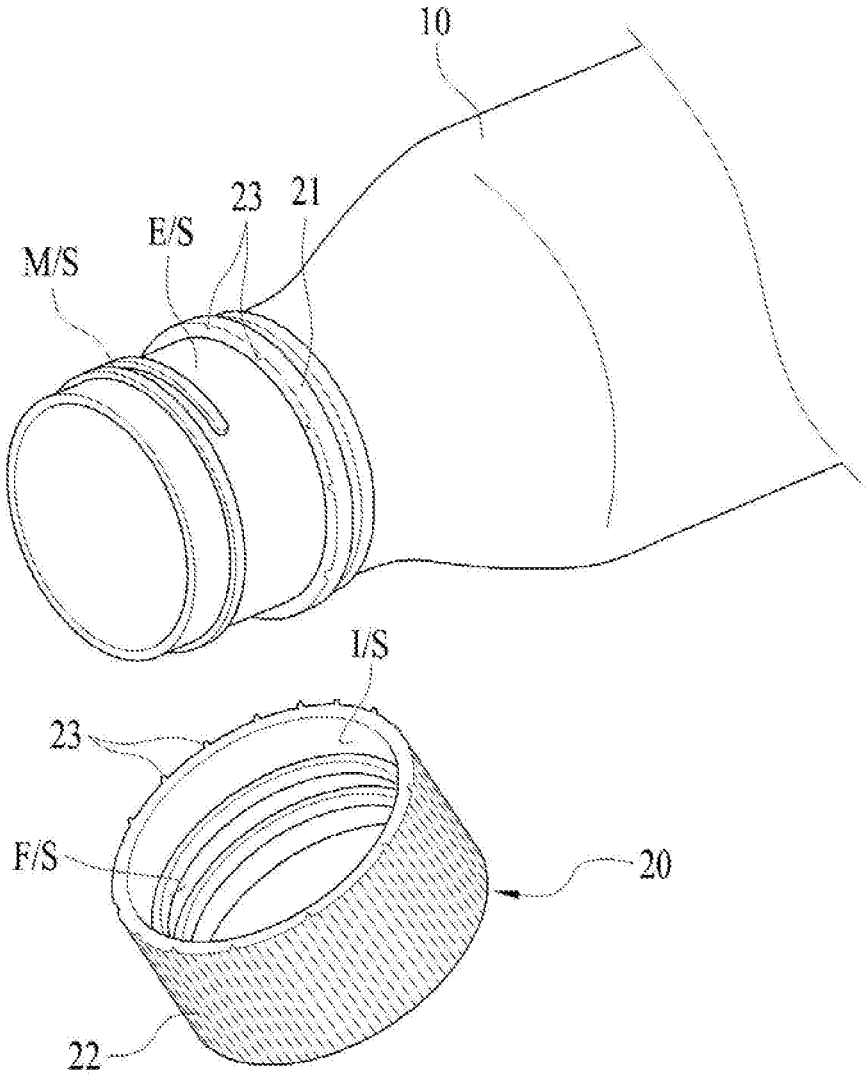
FIGS. 1 and 2 are views illustrating a container cap according to the related art and an action relationship thereof.
Figure 2:
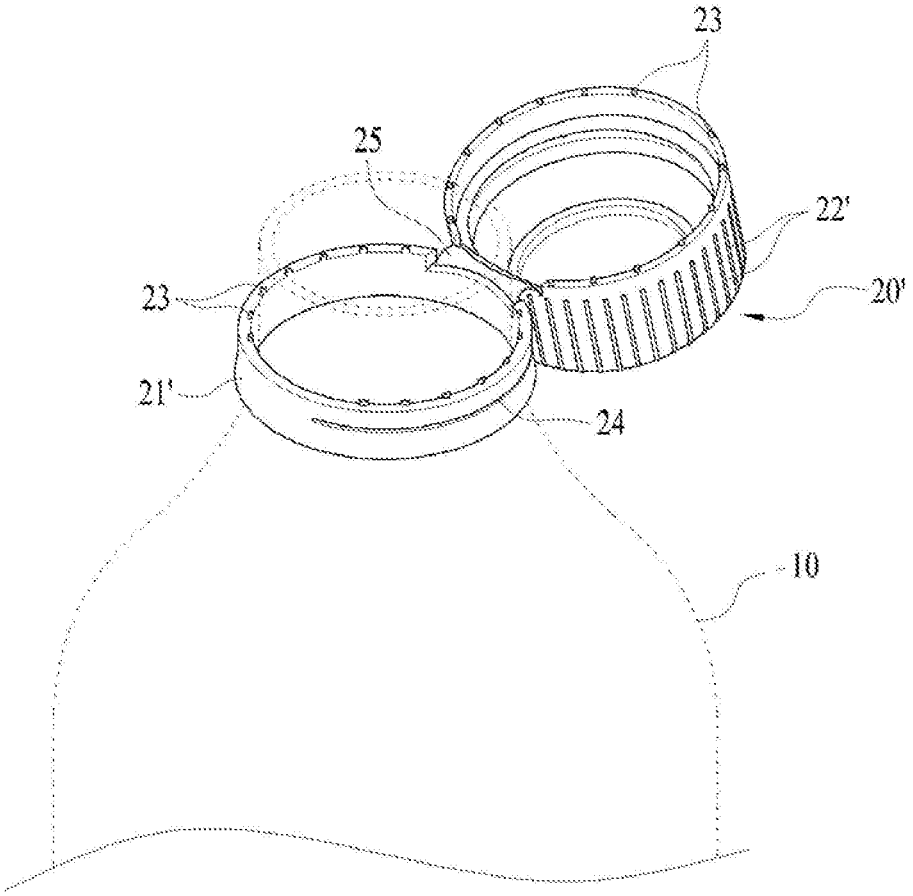
Figure 3:
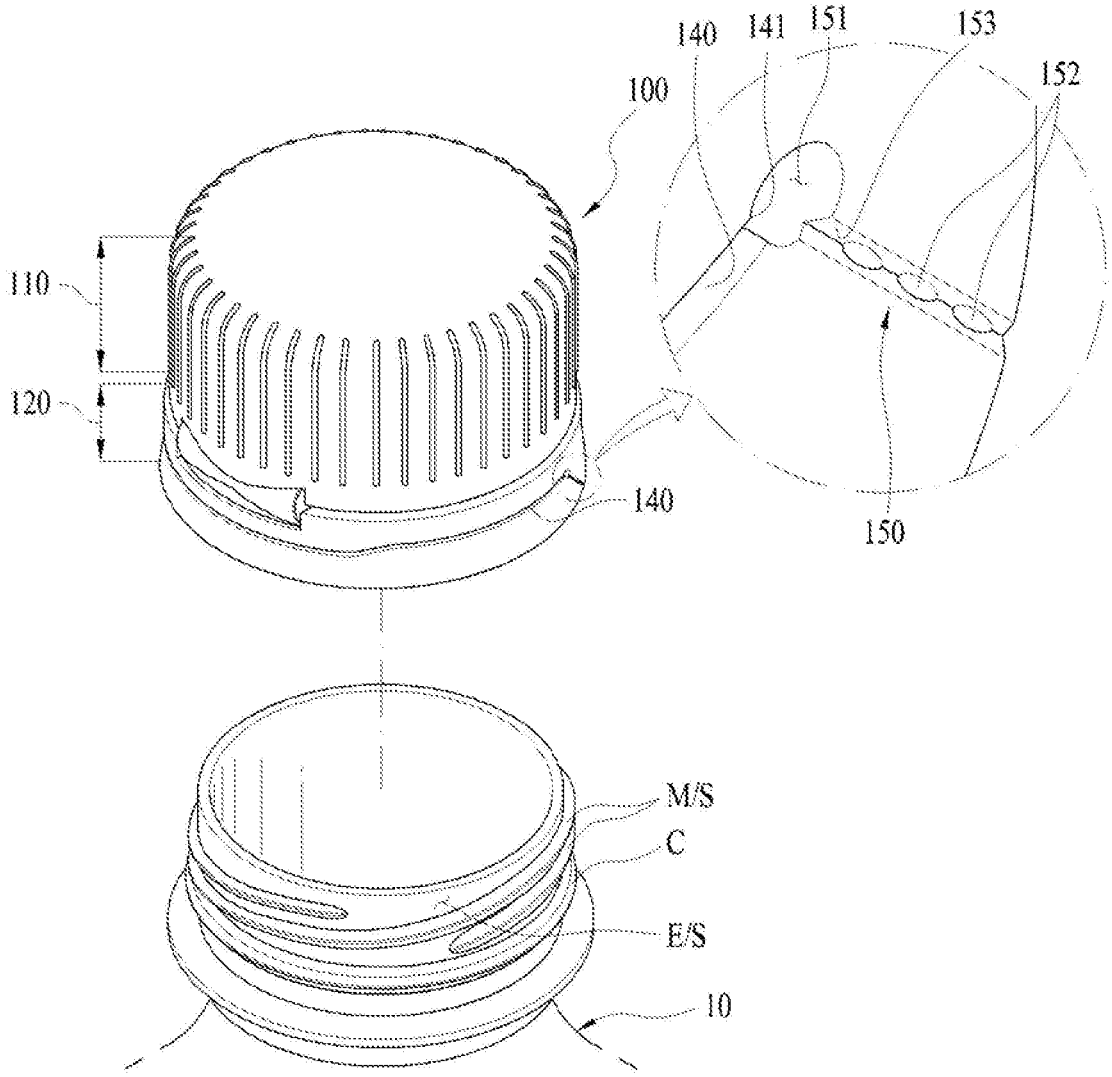
FIGS. 3 and 4 are perspective views illustrating a container cap which is easily and separately collected according to the present disclosure.
Figure 4:
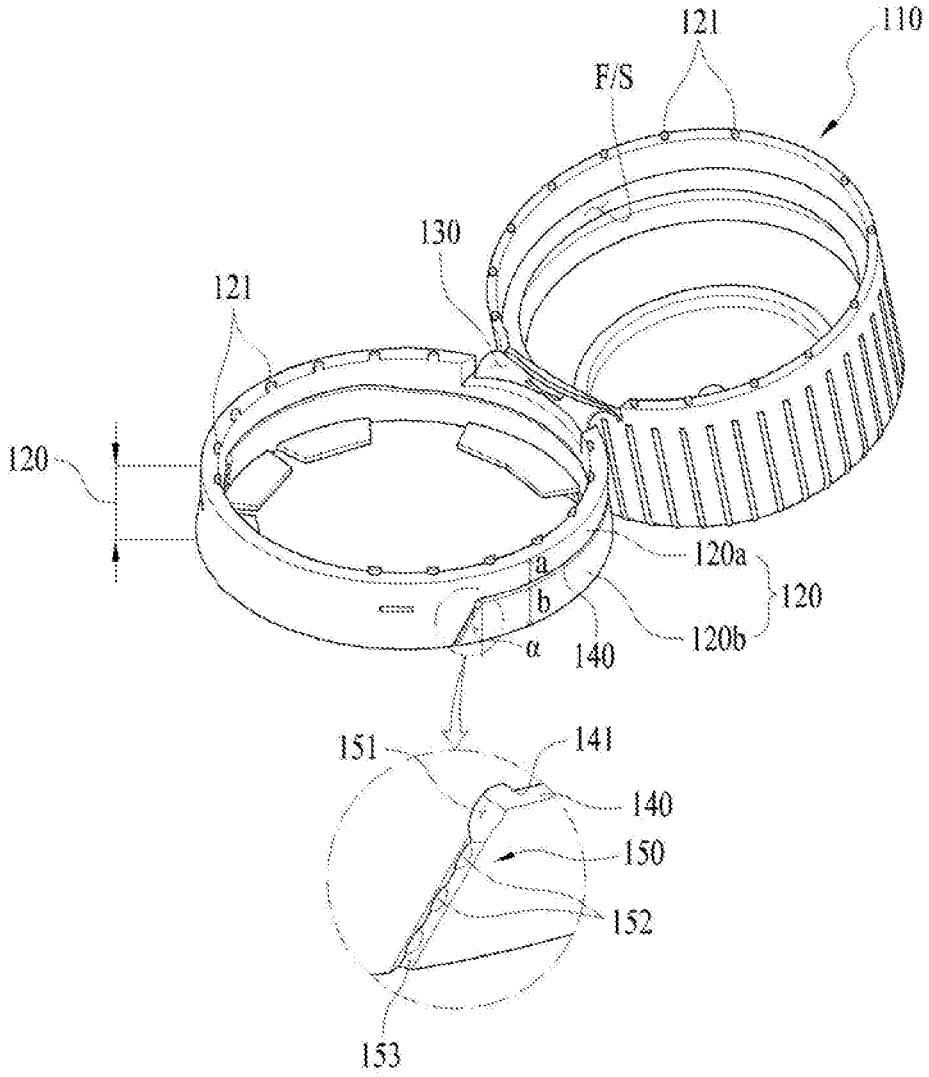
Figure 5A:
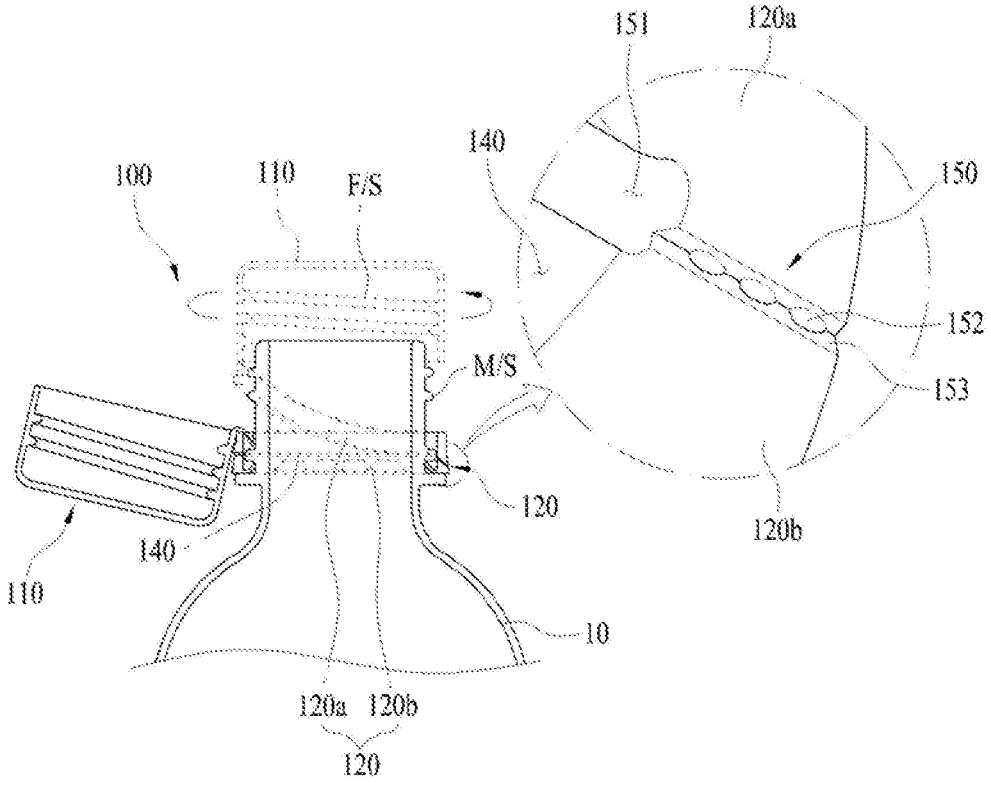
FIGS. 5A, 5B and 5C are an embodiment illustrating a usage state of the container cap which is easily and separately collected according to the present disclosure.
Figure 5B:
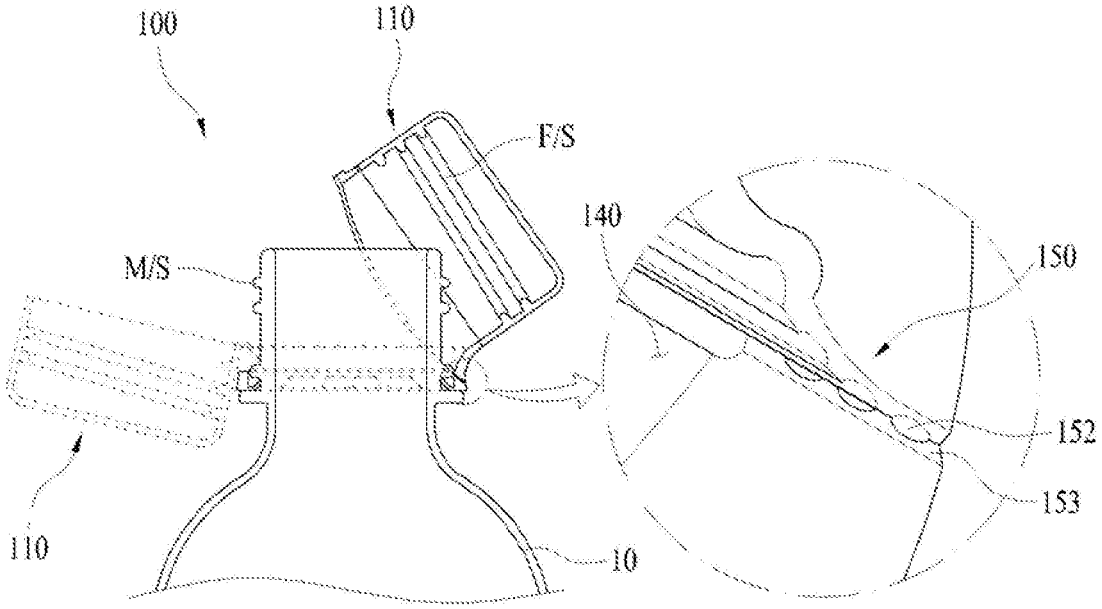
Figure 5C:
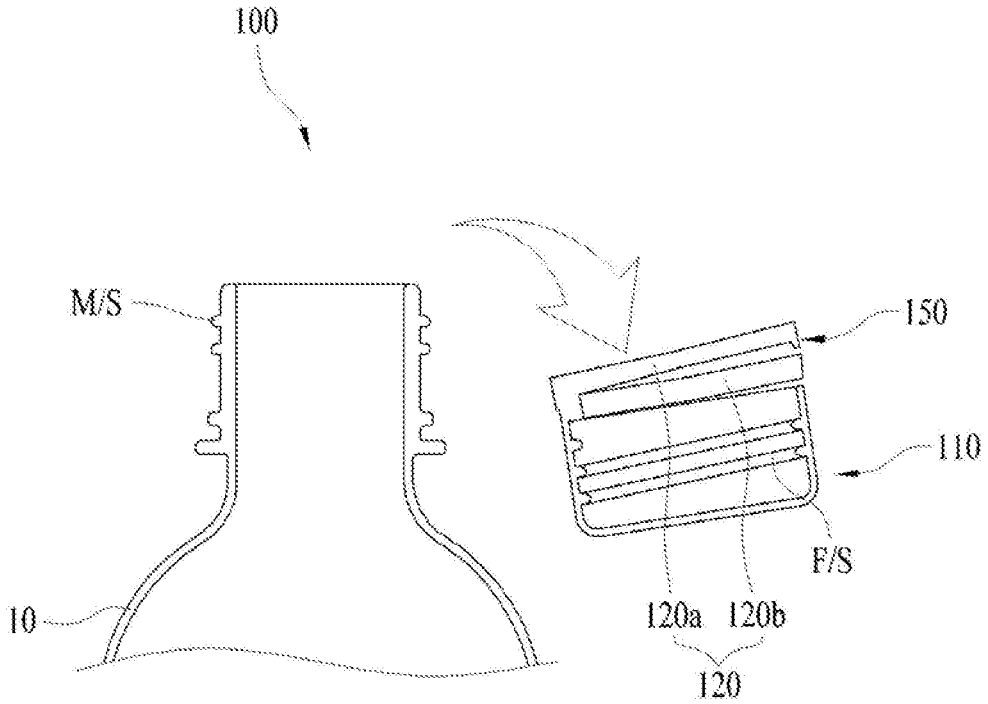

FIGS. 3 and 4 are perspective views illustrating a container cap which is easily and separately collected, according to the present disclosure, and FIGS. 5A, 5B and 5C are an embodiment illustrating a usage state of the container cap which is easily and separately collected according to the present disclosure.

As illustrated, a container cap 100 which is easily and separately collected, according to the present disclosure, may be completely separated from a container 10 after the container 10 is used, so that the container and the container cap having different materials may be separately collected and recycled.

To achieve this, the container cap 100 which is easily and separately collected has a cut part 150 including cut bridges 152 from one end or both ends of the display ring 120 in the lengthwise direction thereof to a lower end of the display ring 120.

As the cut part 150 is formed, a user may separate the display ring 120 from the container without a separate tool such as a knife and nippers.

In detail, referring to FIGS. 3 and 4, the container cap 100 which is easily and separately collected, according to the present disclosure, is coupled to a spout of a container in a screw-coupling scheme by a male screw M/S and a female screw F/S, which is identical to the general container cap according to the related art, and has an opening/closing structure for the container spout according thereto.

In detail, the container cap 100 includes a cap body 110 separated by lifting-up in a screw-coupling scheme, and a display ring 120 connected to one hinge 130 at a lower portion of the cap body 110 by a plurality of bridges 121.

Here, the display ring 120 has a cut slit 140 on a lower side of the hinge 130, and the cut slit 140 is formed by cutting a partial section of a circumference (for example, a half of the circumference) of a central portion of the display ring 120 in the height direction thereof.

When the cap 100 is opened, a portion of the above-described display ring 120, in which the cut slit 140 is formed, is divided into an upper display ring 120*a* and a lower display ring 120*b* and, while being widened, enlarges a connection length between the cap body 110 and the display ring 120 so that the cap body 110 is opened while being connected to the display ring 120.

Referring to FIG. 5A, a general usage state of a container cap using the above-described container cap may be identified. This corresponds to a well-known function, and thus, a detailed action relationship thereof will be omitted to make the subject matter of the present disclosure clear.

Meanwhile, the general container 10 and the general container cap 100 are manufactured of different materials, and after the container 10 is used, the container 10 and the container cap 100 are completely separated from each other as far as possible, so that a separate collection box may improve recycling efficiency.

To this end, the cut part 150 is formed downward from one end or both ends in the longitudinal direction of the cut slit 140 of the display ring 120 to a lower end thereof such that a user or a worker may completely separate the container cap 100 from the container 10 by easily applying external force without a separate tool such as a knife and nippers, as needed.

The cut part 150 has a cut line formed by perforating one or more holes at a portion at which the cut line is to be formed, and the cut line is formed by a plurality of cut bridges 152 to be cut by applying external force.

Referring back to FIGS. 3 and 4, when the cut part 150 is formed, the display ring 120 further has an anti-shock hole 151 formed between an end of the cut slit 140 and an end of the cut part 150 in contact with the cut slit 140.

Such an anti-shock hole 151 serves to concentrate a direction of force applied so as not to unintentionally cut the cut part 150, to the upper display ring 120*a*, when the user opens the container cap 100, that is, when the display ring 120 is divided into the upper display ring 120*a* and the lower display ring 120*b* by the cut slit 140 and enlarges the connection length between the cap body 110 and the display ring 120 while being widened.

It is preferred that the cut part 150 has a slope a at a cut slit end 141 and is formed toward a lower end of the display ring 120 in which the cut slit 140 is not formed. Referring to FIG. 5A, a direction of force generated when the container cap 100 is opened by the anti-shock hole 151 does not face the cut part 150 but faces an end of the upper display ring 120*a* divided by the cut slit 140, in the display ring 120.

Further, it is preferred that the anti-shock hole 151 has an interval that is larger than an interval formed by the cut slit 140 so that the direction of force is formed upward, and it is preferred that an upper end of the anti-shock hole 151 is formed to be higher than an end of the cut slit 140.

In addition, the cut part 150 is formed along a guide groove 153 of which a portion in which the cut bridges 152 are formed is thinner than the thickness of the display ring 120 such that the user or the worker easily separate the container cap 100 while holding the cap body 110 and applying force.

As described above, the cut part 150 formed in the container cap 100 which is easily and separately collected, according to the present disclosure, is formed in consideration of the thickness and the strength of the container such that there is no fracture when the container cap 100 is coupled to the container 10 or the container 10 is opened, and when the user wants to completely separate the container cap 100 from the container 10, the design of the cut part 150 is sufficiently considered such that the cut part 150 may be cut by force pulling the cap body 110.

Next, a usage state of the container cap 100 which is easily and separately collected according to the present disclosure will be described with reference to FIGS. 5A, 5B and 5C.

As described above, the container cap 100 which is easily and separately collected includes a cap body 110 and a display ring 120 formed at a lower portion of the cap body 110 by connecting the hinge 130 and the bridges 121 to each other.

Further, the cut slit 140 is formed by cutting a portion of a circumference of a central portion of the display ring 120 in the height direction thereof, and the cut part 150 including the anti-shock hole 151, the cut bridges 152 and the guide groove 153 is downward formed at an end of the cut slit 140.

First, referring to FIG. 5A, the user grips and rotates the cap body 110 to open the container 10. Here, the bridges 121 are cut and separated, and while the display ring 120 is fixed to the spout of the container, the cap body 110 is lifted up in a screw-coupling scheme, so that the spout of the container is opened.

Here, the upper display ring 120*a* divided by the cut slit 140 increases the connection length while being connected to the cap body 110, so that the cap body 110 may be opened.

Meanwhile, the cut part 150 including the cut bridges 152 formed to a lower end of the display ring 120 is formed at one end or both ends of the cut slit 140 in the lengthwise direction of the cut slit 140 to a lower end of the cut slit 140, and force applied to the increased connection length of the upper display ring 120*a* is not headed to the cut part 150 by the anti-shock hole 151 of the cut part 150 so that the cut part 150 is not cut and the shape of the cut part 150 is maintained.

It is preferred that the cut part 150 has a slope a at the cut slit end 141 and is formed toward a lower end of the display ring 120 in which the cut slit 140 is not formed, and the anti-shock hole 151 has an interval that is larger than an interval formed by the cut slit 140. It is preferred that an upper end of the anti-shock hole 151 is formed to be higher than an end of the cut slit 140.

Meanwhile, as needed, the cut part 150 may be vertically formed at the cut slit end 141 toward a lower end of the display ring 120, and it is apparent that this may be changed depending on the manufacturing and the design of the container cap 100.

Referring to FIG. 5B, after the container is used, the user or the worker completely separates the container cap 100 from the container 10.

To this end, the user holds the cap body 110 and bends the display ring 120 in an opposite direction while the display ring 120 passes through the spout of the container.

Here, the cut part 150 is formed in a direction in which force is applied, and thus, the cut bridges 152 are separated and cut by external force.

Further, as illustrated in FIG. 5C, the container cap 100 is completely separated and escapes from the container 10, and the container 10 and the container cap 100 having different materials are separately collected.

A usage state of the container cap 100 described in FIGS. 5A to 5C is merely an embodiment for easily and completely separating the container cap 100 from the container 10 using the lowest force, and it is obvious that the user may pull the cap body 110 of the container cap 100 in a lateral direction without bending the cap body 110 of the container cap 100 so that the container cap 100 and the container 10 may be separated by the cut part 150.

The above-described present disclosure may be variously substituted, modified and changed by those skilled in the art to which the present disclosure pertains without departing from the technical spirit of the present disclosure, so that the present disclosure is not limited to the above-described embodiment and the accompanying drawings.

REFERENCE NUMERALS

| | | | |
|---|---|---|---|
| 10: | Container | 100: | Container cap |
| 110: | Cap body | 120: | Display ring |
| 120a: | Upper display ring | 120b: | Lower display ring |
| 121: | Bridge | 130: | hinge |
| 140: | Cut slit | 141: | Cut slit end |
| 150: | Cut part | 151: | Anti-shock hole |
| 152: | Cut bridge | 153: | Guide groove |

What is claimed is:

1. A container cap which is easily and separately collected, the container cap comprising a cap body having a screw-coupling scheme, and a display ring provided below the cap body, a hinge and a plurality of bridges that connect the display ring to the cap body, and, a cut slit being provided below the hinge, the cut slit being formed on a partial section of a circumference of a central portion of the display ring, wherein the displaying ring is divided into an upper displaying ring and a lower displaying ring by the cut slit, wherein the display ring has a cut part including cut bridges formed at one end side or both end sides of the cut slit and, wherein the cut part is formed vertically at one end or both ends of the lower displaying ring only without being formed in the upper displaying ring such that the upper displaying ring is formed without any cut parts.

2. The container cap of claim 1, wherein the display ring further has anti-shock hole formed between an end of the cut slit and an end of the cut part, which is in contact with the end of the cut slit.

3. The container cap of claim 2, wherein the anti-shock hole has an interval that is larger than an interval formed by the cut slit.

4. The container cap of claim 2, wherein an upper end of the anti-shock hole is higher than an end of the cut slit.

5. The container cap of claim 1, wherein a guide groove that is thinner than a thickness of the display ring is formed in a portion of the cut part, in which the cut bridges are formed.

6. The container cap of claim 1, wherein the cut part has a slope a at a cut slit end and is formed toward a lower end of the display ring, at which the cut slit is not formed.

* * * * *